United States Patent [19]

Kato et al.

[11] 4,299,889

[45] Nov. 10, 1981

[54] CONTACT FOR VACUUM INTERRUPTER

[75] Inventors: Masaru Kato; Hitoshi Takeuchi; Toshiaki Horiuchi, all of Amagasaki, Japan

[73] Assignee: Mitsubishi Denki Kabushiki Kaisha, Tokyo, Japan

[21] Appl. No.: 41,196

[22] Filed: May 21, 1979

[30] Foreign Application Priority Data

May 22, 1978 [JP] Japan ..... 53-61458

[51] Int. Cl.[3] ..... B22F 7/00

[52] U.S. Cl. ..... 428/569; 428/567; 428/568; 75/248

[58] Field of Search ..... 75/248; 428/569, 567

[56] References Cited

U.S. PATENT DOCUMENTS 2,034,550 3/1936 Adams ..... 428/569
2,391,456 12/1945 Hansel ..... 428/569
3,153,163 10/1964 Foldes et al. ..... 428/569
3,438,753 4/1969 Kenney et al. ..... 428/569
3,489,530 1/1970 Schreiner ..... 428/569

FOREIGN PATENT DOCUMENTS 836115 3/1970 Canada .

*Primary Examiner*—Brooks H. Hunt
*Attorney, Agent, or Firm*—Oblon, Fisher, Spivak, McClelland & Maier

[57] ABSTRACT

A contact for a vacuum interrupter has excellent characteristics of high withstand voltage, large current durability and low chopping current and is prepared by infiltrating copper into a skeleton obtained by sintering a specific tungsten powder having an average diameter of less than 1 μm.

The skeleton is preferably prepared by a vacuum sintering process and the copper is infiltrating into the skeleton in hydrogen atmosphere or in vacuum.

3 Claims, 2 Drawing Figures

CONTACT FOR VACUUM INTERRUPTER

BACKGROUND OF THE INVENTION

1. Field of the Invention

The present invention relates to a contact for a vacuum interrupter which has excellent characteristics of high withstand voltage, large current durability and low chopping current.

2. Description of the Prior Arts

The important characteristics of a contact for a vacuum interrupter include:

(1) high interrupting property of a current interrupter;

(2) high withstand voltage;

(3) small contact resistance;

(4) low melt-bonding force;

(5) low erosion of a contact; and (6) small chopping current.

It has been difficult to obtain a contact which is practically used and has all satisfactory characteristics. Accordingly, it has been considered to use a contact which has certain important characteristics even though the contact has inferior characteristics for other features depending upon its usage for a vacuum interrupter.

For example, a copper-bismuth alloy (Cu-Bi) has been mainly used for a contact for a vacuum interrupter. According to our experience, a contact made of the Cu-Bi alloy has the following disadvantages. A contact made of the Cu-Bi alloy containing less than 0.5 wt. % of Bi has large chopping current whereas a contact made of the Cu-Bi alloy containing more than 0.5 wt. % of Bi has relatively low withstand voltage.

When the chopping current is large, there is a possibility to cause abnormal voltage between contacts. When the withstand voltage is low, the contact can not be used in a high voltage circuit.

On the other hand, it has been well-known that a contact made of tungsten has high withstand voltage in vacuum. However, tungsten is a heat resistant metal whereby thermionic emission characteristic is high and metal vapor pressure is low. Accordingly, high chopping property can not be expected for a contact made of tungsten itself. Tungsten has low conductivity whereby contact resistance between the contacts is great, whereby it is difficult to use tungsten itself for a circuit interrupter having large current capacity in view of elevation of temperature.

It is effective to add copper in order to overcome the disadvantages of tungsten. A copper-tungsten alloy can be a substrate for a contact having high withstand voltage. However, the chopping current of the copper-tungsten alloy is affected by the interrupting properties of copper itself, tungsten itself and the interface between copper and tungsten and also a ratio of copper to tungsten.

The chopping current is increased depending upon increasing a ratio of copper to tungsten (wt. %) in the mixture of copper and tungsten. However, the chopping current is smaller depending upon decreasing diameter of particles of tungsten in the case of a constant ratio of copper to tungsten (wt. %).

The phenomenon is caused by the following reason.

The conductivity of copper is remarkably greater than that of tungsten whereby clear shunt phenomenon is resulted in the small current region near the chopping current. Accordingly, the current is mainly passed through copper parts.

When the skeleton of tungsten is formed by smaller particles of tungsten powder, the copper component is finely and uniformly dispersed to reduce the part of pool of the copper component.

The part of the copper component dispersed finely and uniformly has smaller heat capacity to give higher elevation of temperature by a constant current and to reduce the chopping current in comparison with the part of pool of the copper component.

SUMMARY OF THE INVENTION

It is an object of the present invention to provide a contact for a vacuum interrupter having small chopping current wherein a copper component is finely and uniformly dispersed.

It is another object of the present invention to provide a contact for a vacuum interrupter having excellent characteristics for a melt bonding property, a hardness, a contact resistance and arcing time for interrupting.

The foregoing and other objects of the present invention have been attained by providing a contact which is prepared by infiltrating copper into a skeleton formed by using tungsten powder having a diameter of less than 1 μm.

DETAILED DESCRIPTION OF THE PREFERRED EMBODIMENTS

One embodiment of the present invention will be illustrated.

Figure 1:
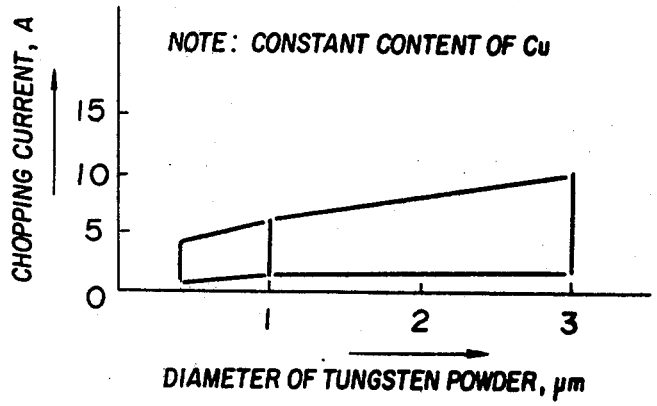
FIG. 1 is a graph showing the relation of diameters of tungsten powder and chopping currents.

FIG. 1 shows the chopping currents for the contact made of a copper-tungsten alloy (Cu-W) which is prepared by infiltrating copper into a skeleton formed by using tungsten powder having an average diameter of about 3 μm and the chopping currents for the contact made of a copper-tungsten alloy (Cu-W) which is prepared by infiltrating copper into a skeleton formed by using tungsten powder having an average diameter of about 1 μm and the chopping currents for the contact made of a copper-tungsten alloy (Cu-W) which is prepared by infiltrating copper into a skeleton formed by using tungsten powder having an average diameter of about 0.5 μm.

The chopping current of the contact made of the copper-tungsten is small.

As it is clear from FIG. 1, when an average diameter of the tungsten particle is less than 1 μm, the chopping current of the contact made of the copper-tungsten is remarkably small. In accordance with the present invention, the contact for a vacuum interrupter of the present invention is prepared by infiltrating copper into the skeleton formed by using the tungsten powder having an average diameter of less than 1 μm.

In accordance with the present invention, a content of copper is ranging from 14 to 4.5 wt. % whereby a ratio of apparent density to true density of the skeleton of tungsten is ranging from 70 to 90%.

As described above, the withstand voltage is increased and the chopping current is decreased depending upon decreasing the content of copper (wt. %) in the contact for a vacuum interrupter.

When the content of copper is less than 14 wt. %, the chopping current is remarkably small. This fact is confirmed by the experiments.

Figure 2:
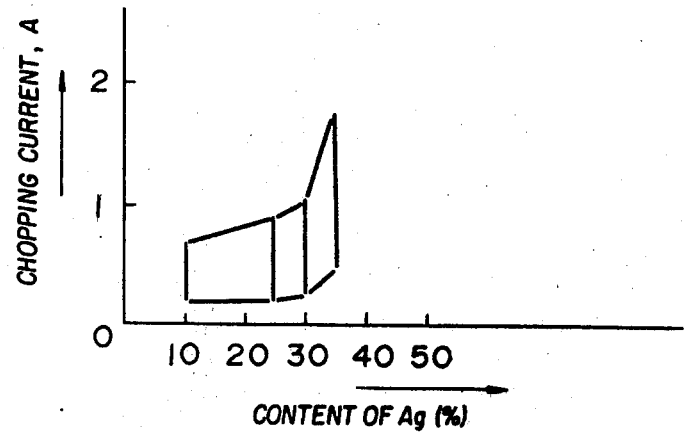
FIG. 2 is a graph showing the relation of contents of silver (Ag) and chopping currents.

FIG. 2 shows the relation of the chopping currents and the content of silver (wt. %) in the conventional contact for a vacuum interrupter which is made of silver-tungsten carbide (Ag-WC).

In this embodiment, an average diameter of the tungsten carbide is about 4 μm. In FIG. 2, it is understood that the chopping current is remarkably decreased when the content of silver is less than 30 wt. %.

From these facts, it is clear that the chopping current is remarkably small when the content of copper in the copper-tungsten contact or the content of silver in the silver-tungsten carbide contact is less than a specific level (wt. %).

Thus, the copper-tungsten alloy can be prepared by infiltrating copper in the skeleton of tungsten.

The skeleton of tungsten having high ratio of apparent density to true density can be obtained by sintering at high temperature such as about 2000° C. It is preferable to use a vacuum furnace in view of the maximum temperature in the sintering in comparison with an atmospheric furnace.

The skeleton of tungsten having a ratio of apparent density to true density of more than 70% is prepared by a vacuum sintering in a powdery metallurgy and copper is infiltrated into the tungsten skeleton to obtain the contact made of the copper-tungsten alloy.

Even though copper powder and tungsten powder are premixed and the mixture is sintered by a vacuum sintering in a powder metallurgy, a desired sintered alloy could not be obtained because the operation is carried out in vacuum and the sintering temperature is remarkably higher than the melting point of copper to be boiling condition of copper.

The contact of the present invention has high withstand voltage because of strong tungsten skeleton and small content of copper (wt. %). The consumption of the contact under large current load is also small by the same reason.

The most important advantage is to be low chopping current because copper is finely and uniformly distributed. The contact for a vacuum interrupter of the present invention which is prepared as described, also has excellent other characteristics in its tests for a melt bonding force a hardness, a contact resistance and an arcing time for interrupting.

From the above described facts, it has been found that the copper-tungsten alloy prepared by infiltrating copper into the skeleton formed by using the tungsten powder having an average diameter of less than 1 μm is suitable for a contact for a vacuum interrupter which has excellent characteristics of high withstand voltage, large current durability, and small chopping current.

What is claimed is:

1. A contact for a vacuum interrupter which is prepared by infiltrating from 4.5 to 14 wt. % of copper into a skeleton formed by sintering tungsten powder having an average diameter of less than 1 μm.

2. A contact for a vacuum interrupter according to claim 1 wherein a ratio of apparent density to true density of the skeleton of tungsten is ranging from 70% to 90%.

3. A contact for a vacuum interrupter according to claim 1 wherein copper is infiltrated into the skeleton of tungsten in a hydrogen atmosphere or in vacuum.

* * * * *